US008441196B2

(12) United States Patent
Liu

(10) Patent No.: US 8,441,196 B2
(45) Date of Patent: May 14, 2013

(54) MULTI-COLOR LIGHT EMITTING DEVICE CIRCUIT

(75) Inventor: Jing-Meng Liu, Zhubei (TW)

(73) Assignee: Richtek Technology Corporation, R.O.C., Chupei, Hsin-Chu (TW)

( * ) Notice: Subject to any disclaimer, the term of this patent is extended or adjusted under 35 U.S.C. 154(b) by 209 days.

(21) Appl. No.: 13/175,653

(22) Filed: Jul. 1, 2011

(65) Prior Publication Data

US 2013/0002153 A1 Jan. 3, 2013

(51) Int. Cl.
*H05B 37/00* (2006.01)

(52) U.S. Cl.
USPC ..... 315/185 R; 315/192; 315/193; 315/224; 315/291; 315/294; 315/360

(58) Field of Classification Search ..... 315/185 R, 315/186, 192, 193, 224, 247, 291, 294, 297, 315/307, 312, 360
See application file for complete search history.

(56) References Cited

U.S. PATENT DOCUMENTS

| | | | | |
|---|---|---|---|---|
| 6,847,169 | B2 * | 1/2005 | Ito et al. | 315/77 |
| 7,893,626 | B2 * | 2/2011 | Liu | 315/185 R |
| 8,344,659 | B2 * | 1/2013 | Shimomura et al. | 315/307 |
| 2009/0187925 | A1 * | 7/2009 | Hu et al. | 719/327 |
| 2010/0308738 | A1 * | 12/2010 | Shteynberg et al. | 315/185 R |

* cited by examiner

*Primary Examiner* — Haiss Philogene
(74) *Attorney, Agent, or Firm* — Tung & Associates

(57) ABSTRACT

The present invention discloses a multi-color light emitting device circuit, which includes: multiple light emitting device strings of different colors, a timing control circuit, a power regulator circuit, and preferably a dark feedback circuit. Each light emitting device string has multiple light emitting devices coupled in series. The number of the light emitting devices of each light emitting device string is determined by an operational voltage of the light emitting device, wherein at least two of the light emitting device strings have different numbers of the light emitting devices, such that voltage drops of the two light emitting device strings are closer to each other than in a case wherein the two light emitting device strings have the same number of the light emitting devices, and the response time of the light emitting device strings are increased.

14 Claims, 14 Drawing Sheets

MULTI-COLOR LIGHT EMITTING DEVICE CIRCUIT

CROSS REFERENCE

The present invention claims priority to U.S. provisional application No. 61/368,769, filed on Jul. 29, 2010.

BACKGROUND OF THE INVENTION

1. Field of Invention

The present invention relates to a multi-color light emitting device circuit; particularly, it relates to a multi-color light emitting device circuit, wherein the number of light emitting devices of each light emitting device string in the multi-color light emitting device circuit is determined by an operational voltage of the light emitting device according to its color.

2. Description of Related Art

A so-called "RGB color sequential technique" is proposed for use in a light emitting diode (LED) projector, in which the red, green and blue LEDs sequentially emit light with a settling time between different colors, such that as a whole the LED projector projects an image with complete colors to a user. For a hand-held LED projector, as shown in FIG. 1, the red, green and blue LEDs typically share one DC-DC power regulator circuit 100 to minimize the size of the projector and reduce the manufacturing cost. In this prior art LED projector, when one color LED (i.e., RLED, GLED, or BLED) is programmed to emit light, a logic gate 12 controls a switch 14 according to a corresponding light emission signal R, G, or B to select a supply voltage Vout to be supplied to a multi-color light emitting device group 20; and in the mean while, a transistor Q1, Q2, or Q3 also turns ON according to the light emission signal R, G, or B, such that a selected color LED string of the multi-color light emitting device group 20 turns ON.

In the prior art shown in FIG. 1, according to the selection by the switch 14, either a voltage drop across a sensing resistor Rs or a voltage at the node between a first resistor R1 and a second resistor R2 is fed back to the DC-DC power regulator circuit 100 so that it generates the proper supply voltage Vout. More specifically, the operational voltages of the red, green and blue LEDs are different. In general, a white LED has an operational voltage of about 3.2V-3.8V; a red LED has an operational voltage of about 1.9V-2.6V; a green LED has an operational voltage of about 2.9V-3.7V; a blue LED has an operational voltage of about 3.0V-3.8V. For simplicity in explaining, in the prior art shown in FIG. 1, the operational voltage of the red LED RLED is assumed to be 2.3V, the operational voltage of the green LED GLED is assumed to be 3.6V, and the operational voltage of the blue LED BLED is assumed to be 3.6V. If the supply voltage Vout is set to be 0V when all the red, green and blue LEDs are OFF (dark status), there will be a large voltage difference (2.3V or 3.6V) in the supply voltage Vout between turning ON one color LED and the dark status, and the circuitry will suffer a slow response time. Therefore, a dark level between the aforementioned operational voltages 2.3V and 3.6V, such as 3V, is provided in the prior art, and when all the red, green and blue LEDs are OFF, the supply voltage is set to this dark level, such that the voltage difference between the dark status and turning ON one color LED ON is reduced, to increases the response speed of the circuitry. In the dark status, all the red, green and blue LEDs are OFF, and the switch 14 switches the DC-DC power regulator circuit 100 to receive a dark feedback signal from a dark feedback circuit 13 (including the first resistor R1 and the second resistor R2) according to the output signal from the logic gate 12. The resistances of the first resistor R1 and the second resistor R2 are properly arranged such that the supply voltage Vout is kept between the aforementioned operational voltages 2.3V and 3.6V, such as 3V.

An example of the waveform of the supply voltage Vout generated by the aforementioned prior art is shown in FIG. 2. Even though the voltage difference between the dark level and turning ON one color LED is reduced, the voltage difference between the operational voltages of the red LED (RLED) and the other two color LEDs (GLED and BLED) is still very large, i.e., 1.3V, or even greater if more LEDs are connected in one LED string. Thus, a relatively long period is required for charging/discharging an output capacitor C1 during the process of switching between the red LED RLED and one of the other two color LEDs (GLED and BLED), such that the switching time between different colors is long and it decreases the image contrast. All in all, the response time of the circuitry is still not satisfactory.

If all the LED strings do not share one DC-DC power regulator circuit, but each LED string has it own DC-DC power regulator circuit, the above issue may be solved; however, this is not cost-effective. Therefore, it is necessary to provide a cost-effective multi-color light emitting device circuit with a relatively simple hardware configuration.

In view of the foregoing, the present invention provides a multi-color light emitting device circuit, in which the number of the light emitting devices of each light emitting device string is determined by the operational voltage of the light emitting device of a color substantially the same as the color of the light emitting devices in that light emitting device string, such that the circuitry response speed is increased while the control circuit has a cost-effective simple hardware configuration.

SUMMARY OF THE INVENTION

The objective of the present invention is to provide a multi-color light emitting device circuit.

To achieve the objectives mentioned above, the present invention provides a multi-color light emitting device circuit, including: a plurality of light emitting device strings of different colors, each light emitting device string including a plurality of light emitting devices of a same color coupled in series, wherein each light emitting device string has one end coupled to a common node for receiving an output voltage, and each light emitting device string generates a corresponding sense signal; a timing control circuit, which determines to turn ON a selected one or none of the light emitting device strings; and a power regulator circuit, when the selected one of the light emitting device strings is ON, the power regulator circuit comparing the sense signal corresponding to the selected light emitting device string with a reference signal, and converting an input voltage to the output voltage according to the comparison result; wherein the number of the light emitting devices of each light emitting device string is determined by an operational voltage of a light emitting device of a color substantially the same as the color of the light emitting devices in that light emitting device string, and wherein at least two of the light emitting device strings have different numbers of the light emitting devices, such that voltage drops of the two light emitting device strings are closer to each other than in a case wherein the two light emitting device strings have the same number of the light emitting devices.

In one preferred embodiment, the aforementioned multi-color light emitting device circuit preferably includes a dark feedback circuit for generating a dark feedback signal, when none of the light emitting device strings is ON, the power regulator circuit comparing the dark feedback signal with the reference signal and converting the input voltage to the output voltage according to the comparison result.

In another preferred embodiment, the aforementioned multi-color light emitting device circuit preferably includes a dark feedback circuit for generating a dark feedback signal, when none of the light emitting device strings is ON, the power regulator circuit comparing the dark feedback signal with a dark reference signal and converting the input voltage to the output voltage according to the comparison result.

In one preferred embodiment of the aforementioned multi-color light emitting device circuit, the dark feedback circuit is kept conductive.

In another preferred embodiment, the multi-color light emitting device circuit further includes one common sensing resistor, which is coupled to all of the light emitting device strings, for providing the sense signal.

In yet another preferred embodiment, the multi-color light emitting device circuit further includes multiple sensing resistors, which are coupled to the light emitting device strings respectively, for providing the sense signal.

In the aforementioned embodiment, the multi-color light emitting device circuit preferably further includes a selection circuit, which is coupled to the light emitting device strings at corresponding nodes respectively, to obtain the sense signals corresponding to the light emitting device strings, and select one of the sense signals to be inputted to the power regulator circuit.

In the aforementioned embodiments, the multi-color light emitting device circuit preferably further includes a selection circuit, which receives a plurality of color reference signals, and selects one of the color reference signals as the reference signal, wherein the selected color reference signal corresponds to the light emitting device string determined by the timing control circuit to turn ON.

In the aforementioned embodiments, the multi-color light emitting device circuit preferably further includes a dark feedback circuit for generating a dark feedback signal, and a selection circuit, which is coupled to the light emitting device strings and the dark feedback circuit at corresponding nodes respectively, to obtain the sense signals corresponding to the light emitting device strings and the dark feedback signal, and select one of the sense signals and the dark feedback signal, which is to be inputted to the power regulator circuit.

In the aforementioned embodiments, the selection circuit preferably includes one of the following circuits: a maximum voltage selection circuit, a minimum voltage selection circuit, and a selection circuit controlled by the timing control circuit.

The objectives, technical details, features, and effects of the present invention will be better understood with regard to the detailed description of the embodiments below.

DESCRIPTION OF THE PREFERRED EMBODIMENTS

In the following context, the "multi-color light emitting devices" are described as red, green and blue LEDs for example, but this should not be taken as limitations to the present invention; the light emitting devices can be of any other color or type. A control circuit of the multi-color light emitting devices is referred to as "multi-color light emitting device control circuit", and a circuit including the multi-color light emitting devices and the control circuit is referred to as "multi-color light emitting device circuit".

Figure 1:
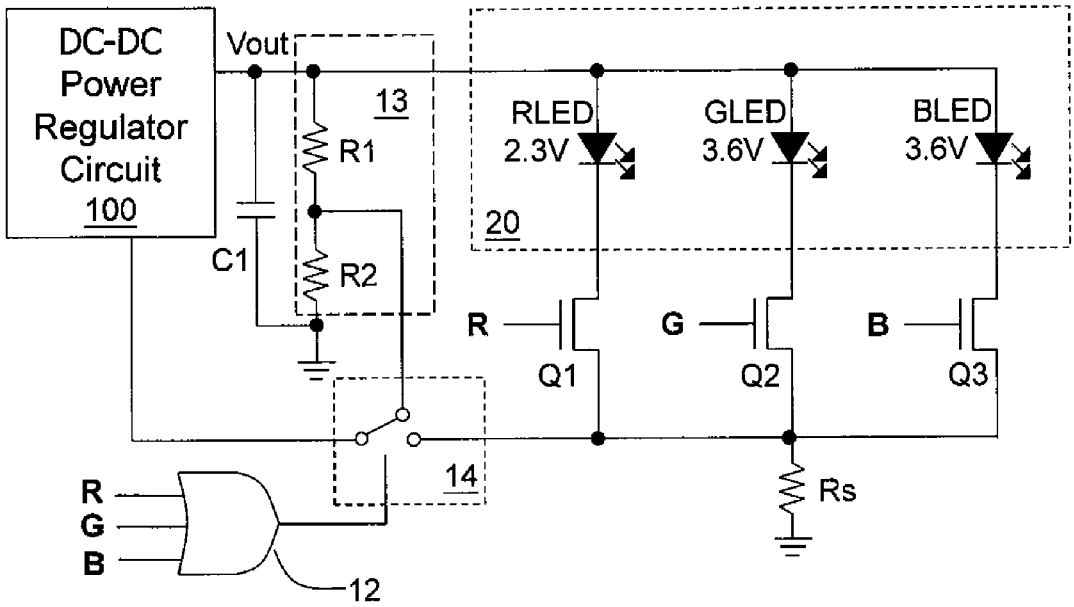
Fig. 1 (Prior Art)
FIG. 1 shows a schematic diagram of a hand-held LED projector including a control circuit.
Figure 2:
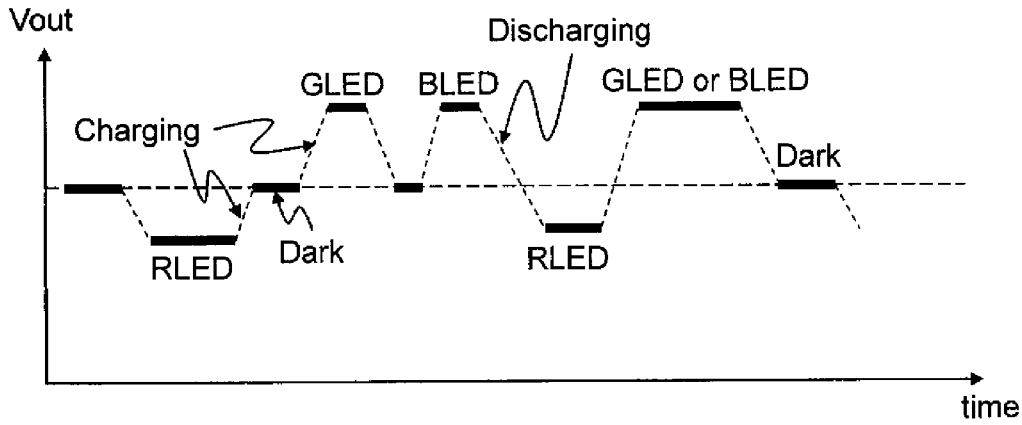
Fig. 2 (Prior Art)
FIG. 2 shows a waveform of the supply voltage Vout of the prior art.
Figure 3A:
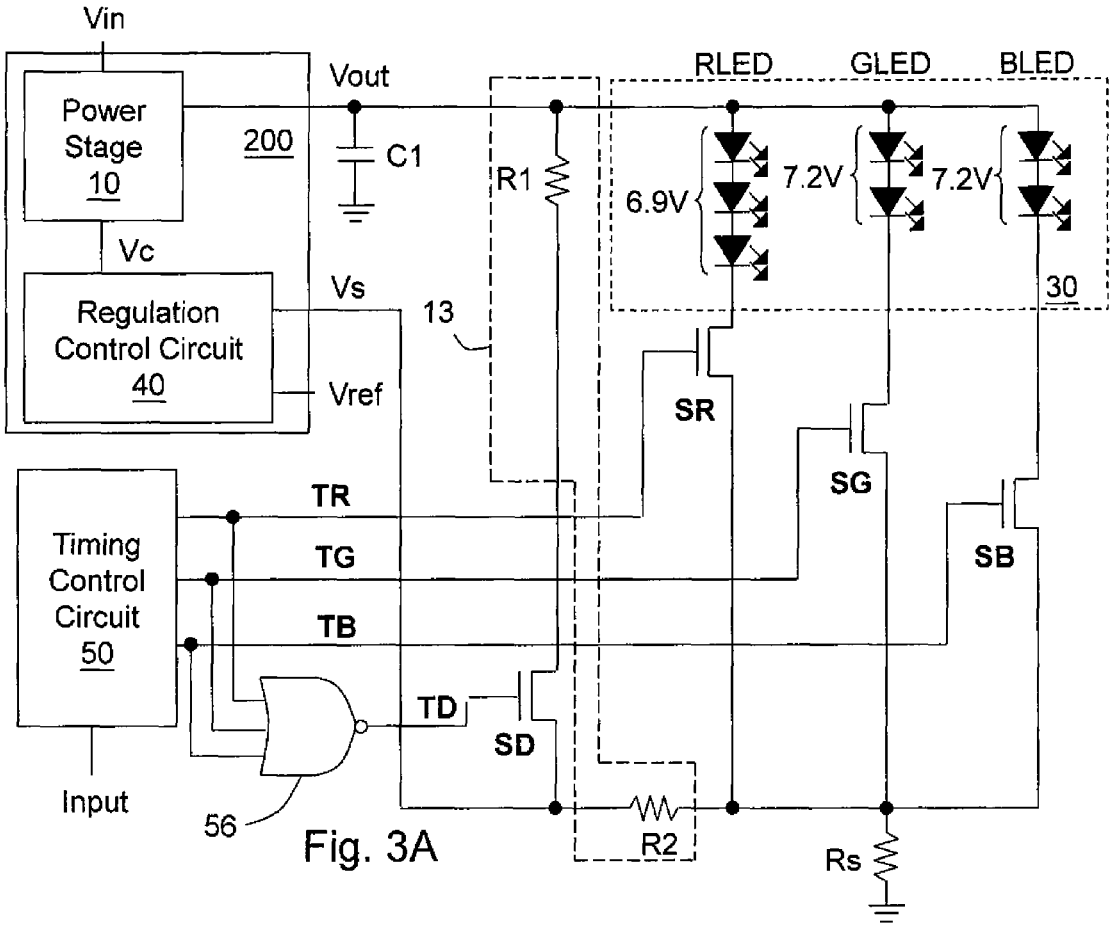
FIGS. 3A and 3B show a first embodiment of the present invention.
Figure 3B:
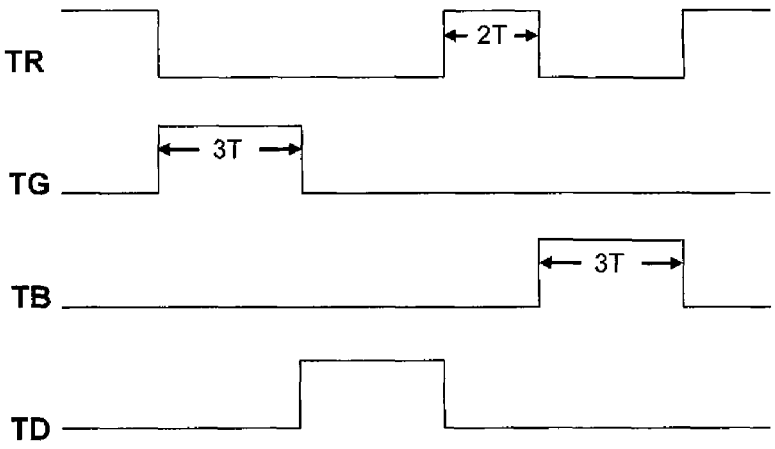

FIGS. 3A and 3B show the first embodiment of the present invention. As shown in FIG. 3A, the multi-color light emitting device circuit includes: a power regulator circuit 200 (including a power stage 10 and a regulation control circuit 40), a timing control circuit 50, a dark feedback circuit 13, a multi-color light emitting device group 30, and a sensing resistor Rs. A logic gate 56 and a switch set (including color switches SR, SG, SB, and a dark switch SD) are shown in FIG. 3A; they may be regarded as part of the timing control circuit 50, but the logic gate 56, the switch set and the timing control circuit 50 are drawn separately in order to illustrate an example as to how the color light emitting devices and the dark feedback circuit 13 are controlled and the relationship between them. More specifically, the timing control circuit 50 controls one color light emitting device string to be turned ON and a corresponding sense signal Vs is delivered to the regulation control circuit 40, or none of the color light emitting device strings to be turned ON and a dark feedback signal generated by a dark feedback circuit 13 is taken as the sense signal Vs and delivered to the regulation control circuit 40. The function of the color switches SR, SG, and SB is to control the light emitting device strings so that they are turned ON individually, while the locations of the color switches are not limited to those as shown in the figure; they can be located anywhere as long as the conduction of the light emitting device strings can be controlled by corresponding switches. The location of the dark SD is also not limited to that as shown in the figure. For example, the dark switch SD may be arranged as shown in FIG. 1, or located above the first resistor R1, or at the right side of the second resistor R2, or anywhere as long as the conduction of the dark feedback circuit can be controlled by the dark switch SD. Further, if the dark level is considered not necessary, the dark feedback circuit 13, the logic gate 56, and the dark switch SD are not required in the circuit.

The multi-color light emitting device group 30 includes multiple light emitting device strings with different colors, for example but not limited to light emitting device strings with red LEDs (RLED), green LEDs (GLED), and blue LEDs (BLED) connected in series, respectively. Each light emitting device string includes a first end, which is coupled to a common node for receiving an output voltage Vout, and a second end, which is coupled to the sensing resistor Rs via the corresponding color switch SR, SG, or SB. The other end of the sensing resistor Rs is coupled to a ground level. The function of the sensing resistor Rs is to obtain a sense signal indicating the current information of a conductive light emitting device string, for feedback controlling the power stage 10 to convert an input voltage Vin to the output voltage Vout having a proper level.

Because the operational voltages of different color LEDs are different, for example, the operational voltage of the RLED is around 2.3V, the operational voltage of the GLED is around 3.6V, and the operational voltage of the BLED is also around 3.6V, the present invention proposes to determine the number of the light emitting devices of each light emitting device string in accordance with the operational voltages of different color LEDs, such that voltage drops of the light emitting device strings are closer to one another than in a case wherein the light emitting device strings have the same number of the light emitting devices.

More specifically, as shown in the embodiment of FIG. 3A, the red LED string has three red LEDs connected in series, the green LED string has two green LEDs connected in series, and the blue LED string has two blue LEDs connected in series. That is, the total operational voltage of the red LED string is 3*2.3V=6.9V, the total operational voltage of the green LED string is 2*3.6V=7.2V, and the total operational voltage of the blue LED string is 2*3.6V=7.2V. Comparing with the prior art, this embodiment reduces the difference between the voltage drops of the red LED string and the blue LED string from 1.3V to 0.3V. Therefore, when the circuitry switches between different color LED strings (or the dark status), the voltage difference in the output voltage Vout is greatly reduced, and the charging/discharging time of the output capacitor C1 is also decreased, such that the color switching transient time is greatly reduced, and the image contrast is increased.

In the multi-color light emitting device circuit, one end of the dark feedback circuit 13 is also coupled to the common node for receiving the output voltage Vout, and the other end of the dark feedback circuit 13 is coupled to the ground level via the sensing resistor Rs. The dark feedback circuit 13 includes a voltage division circuit, formed by the first resistor R1 and the second resistor R2 coupled to each other. The resistances of the first resistor R1 and the second resistor R2 should be properly arranged, such that when the dark switch SD is conductive (i.e., the color switches SR, SG, and SB are OFF), the level of the output voltage Vout is between the total operational voltages of the red LED string and the blue LED string, which is between 6.9V and 7.2V in this embodiment.

The timing control circuit 50 receives an input signal Input, and generates a color timing control signal TR, TG, or TB, or a dark timing control signal TD in response to the input signal Input, to control the color switch SR, SG, or SB, or the dark switch SD. When the color switches SR, SG, and SG are all OFF, the logic gate 56 conducts the dark switch SD. The regulation control circuit 40 receives the sense signal Vs and compares it with a reference signal Vref to generate a control signal Vc for controlling the power stage 10, such that the power stage 10 converts the input voltage Vin to the output voltage Vout according to the control signal Vc. The power stage 10 for example is but not limited to a buck converter, a boost converter, a buck-boost converter, or an inverting converter, etc. as shown in FIGS. 13A-13H. The control signal Vc, which is generated by the regulation control circuit 40 by comparing the sense signal Vs with the reference signal Vref, can control the power stage 10 by pulse width modulation or pulse frequency modulation in various ways, as well known by those skilled in the art, so details thereof are omitted here.

An over voltage protection circuit may be provided to prevent the output voltage Vout from going too high for safety of the multi-color light emitting device circuit. Such over voltage protection circuit is well known by those skilled in the art, and the detailed description thereof is omitted here.

FIG. 3B shows an example of waveforms of the color timing control signals TR, TG, TB, and the dark timing control signal TD. Assuming that in a certain image the brightness of different colors needs to be close to one other, the ON time ratio of the red LED string, the green LED string, and the blue LED string may be controlled at about 2:3:3 as indicated by 2T and 3T shown in the figure, so that the brightness of each color is close to another. When the red LED string, the green LED string, and the blue LED string are all OFF, the dark timing control signal TD conducts the dark switch SD. Certainly, if in some other image the brightness of different colors needs to be different, the ON time ratio of the different color LED strings may be adjusted accordingly.

Figure 4A:
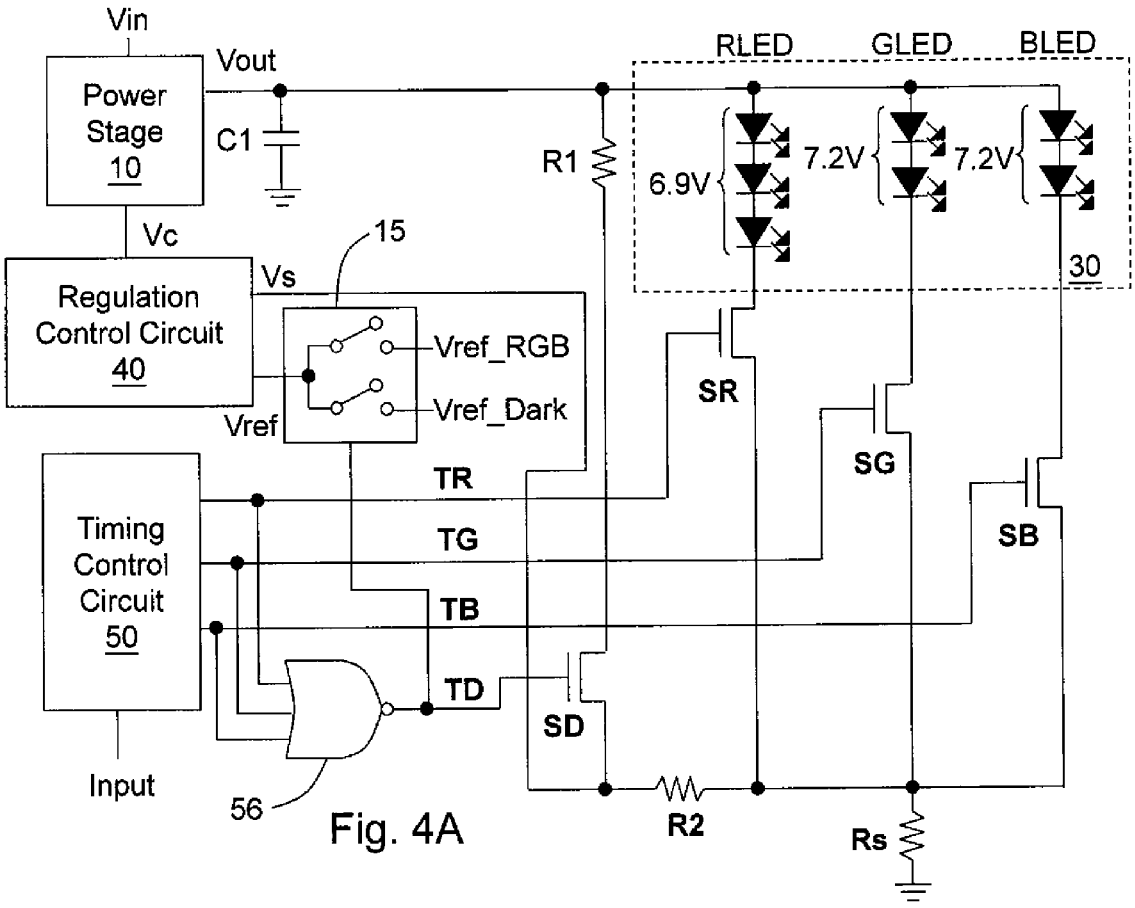
FIGS. 4A and 4B show a second embodiment of the present invention.
Figure 4B:
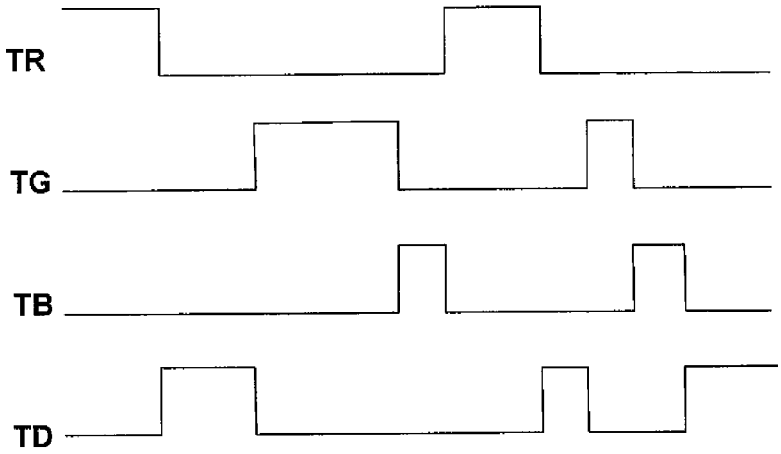

FIGS. 4A and 4B show a second embodiment of the present invention. This embodiment is different from the first embodiment in that, the multi-color light emitting device circuit further includes a first selection circuit 15, which selects a different reference signal as the reference signal Vref according to whether the timing control circuit 50 selects to conduct the color switch SR, SG, or SB, or the dark switch SD. That is, when the timing control circuit 50 generates the color timing control signal TR, TG, or TB to conduct the color switch SR, SG, or SB, the first selection circuit 15 selects a multi-color reference signal Vref_RGB as the reference signal Vref, and when the timing control circuit 50 generates the dark timing control signal TD to conduct the dark switch SD, the first selection circuit 15 selects a dark reference signal Vref_Dark as the reference signal Vref. Options of the different reference signals improves the precision for controlling of the output voltage Vout, and increases the flexibility in circuit design (such as the settings of the resistance of the first resistor R1, the second resistor R2, and the sensing resistor Rs).

FIG. 4B is different from FIG. 3B in that, FIG. 4B is an example showing that when the image needs different brightness of different colors, the ON time ratio of the different color LED strings may be adjusted accordingly.

Figure 5A:
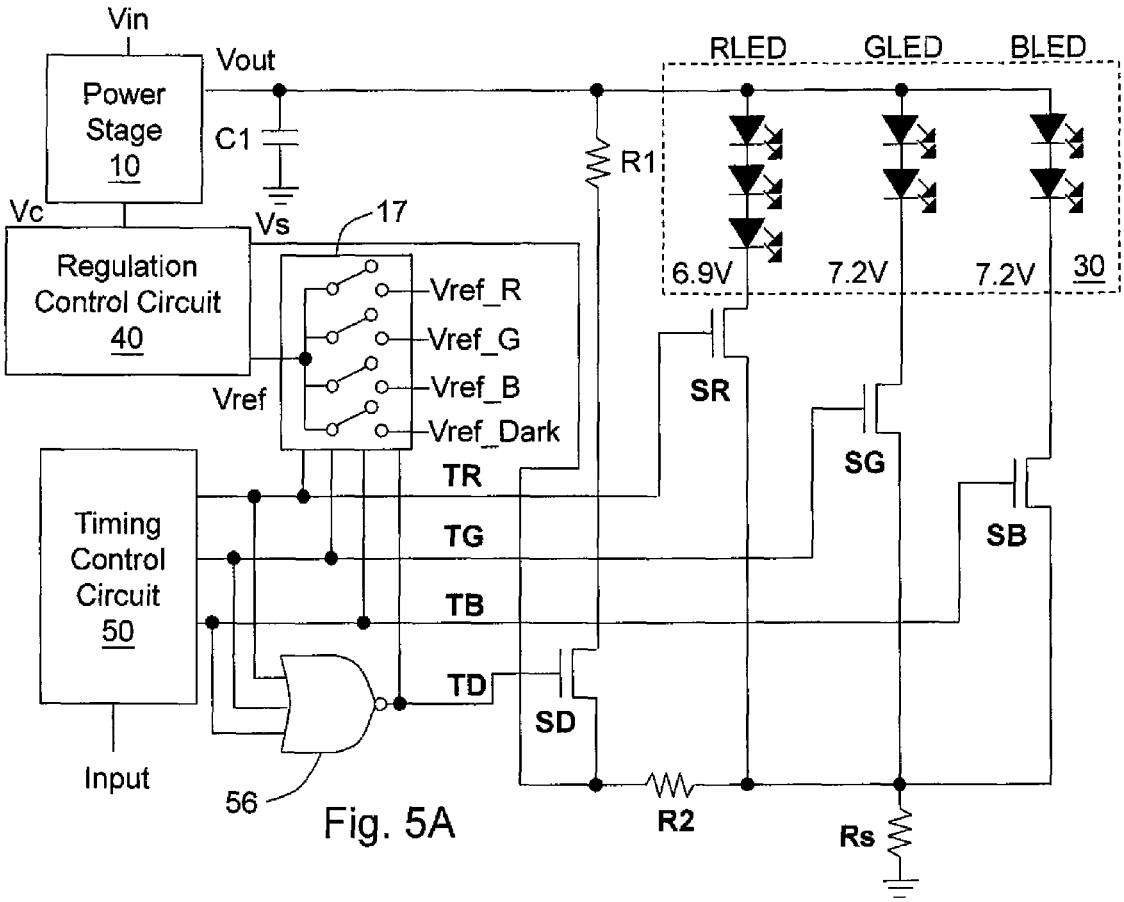
FIGS. 5A and 5B show a third embodiment of the present invention.
Figure 5B:
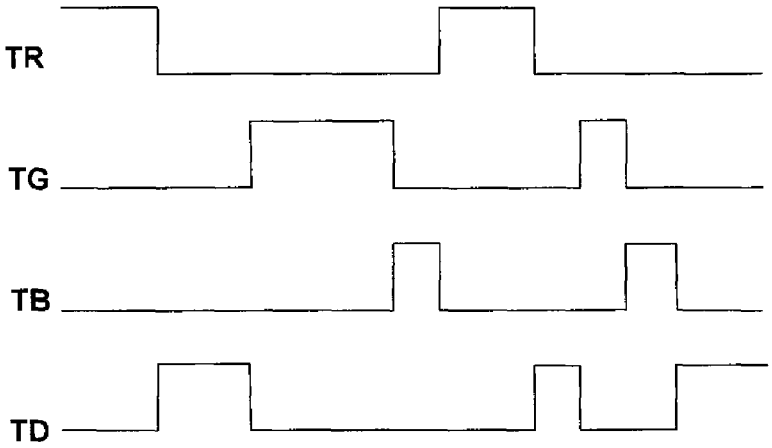

FIGS. 5A and 5B show a third embodiment of the present invention. This embodiment is different from the second embodiment in that, the multi-color light emitting device circuit includes a second selection circuit 17 instead of the first selection circuit 15. The second selection circuit 17 selects the reference signal Vref according to whether the timing control circuit 50 selects to conduct the color switch SR, SG, or SB, or the dark switch SD. That is, when the timing control circuit 50 generates the color timing control signal TR to conduct the color switch SR, the second selection circuit 17 selects a red color reference signal Vref_R as the reference signal Vref; when the timing control circuit 50 generates the color timing control signal TG to conduct the color switch SG, the second selection circuit 17 selects a green color reference signal Vref_G as the reference signal Vref; when the timing control circuit 50 generates the color timing control signal TB to conduct the color switch SB, the second selection circuit 17 selects a blue color reference signal Vref_B as the reference signal Vref; and when the timing control circuit 50 generates the dark timing control signal TD to conduct the dark switch SD, the second selection circuit selects the dark reference signal Vref_Dark as the reference signal Vref. The more options of the reference signal Vref in this embodiment further increases the accuracy of the output voltage Vout, and increases the flexibility in circuit design (such as more flexibility of the resistance setting of the first resistor R1, the second resistor R2, and the sensing resistor Rs); in addition to the above, the settings of the color reference signals Vref_R, Vref_G, and Vref_B may be used to control the brightness of the color light emitting device strings such that they have the same brightness under the same ON time without requiring controlling the ON time ratio. Certainly, the user still may control the brightness of the color light emitting device strings by the ratio of the ON time. FIG. 5B is an example showing that the ratio of the ON time of the color light emitting device strings does not have to be 2:3:3 as aforementioned.

Figure 6A:
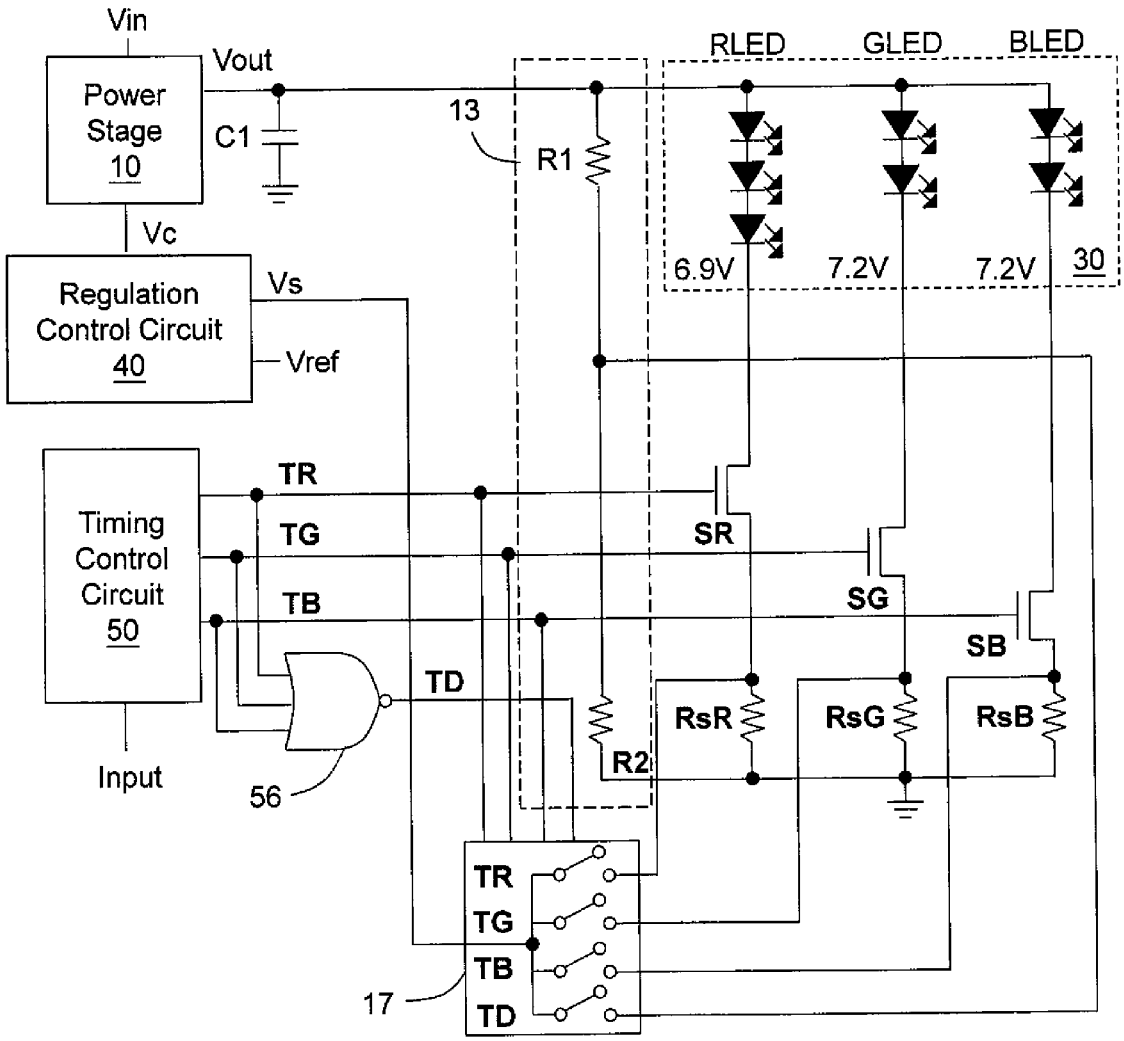
FIGS. 6A and 6B show a fourth and fifth embodiments of the present invention.
Figure 6B:
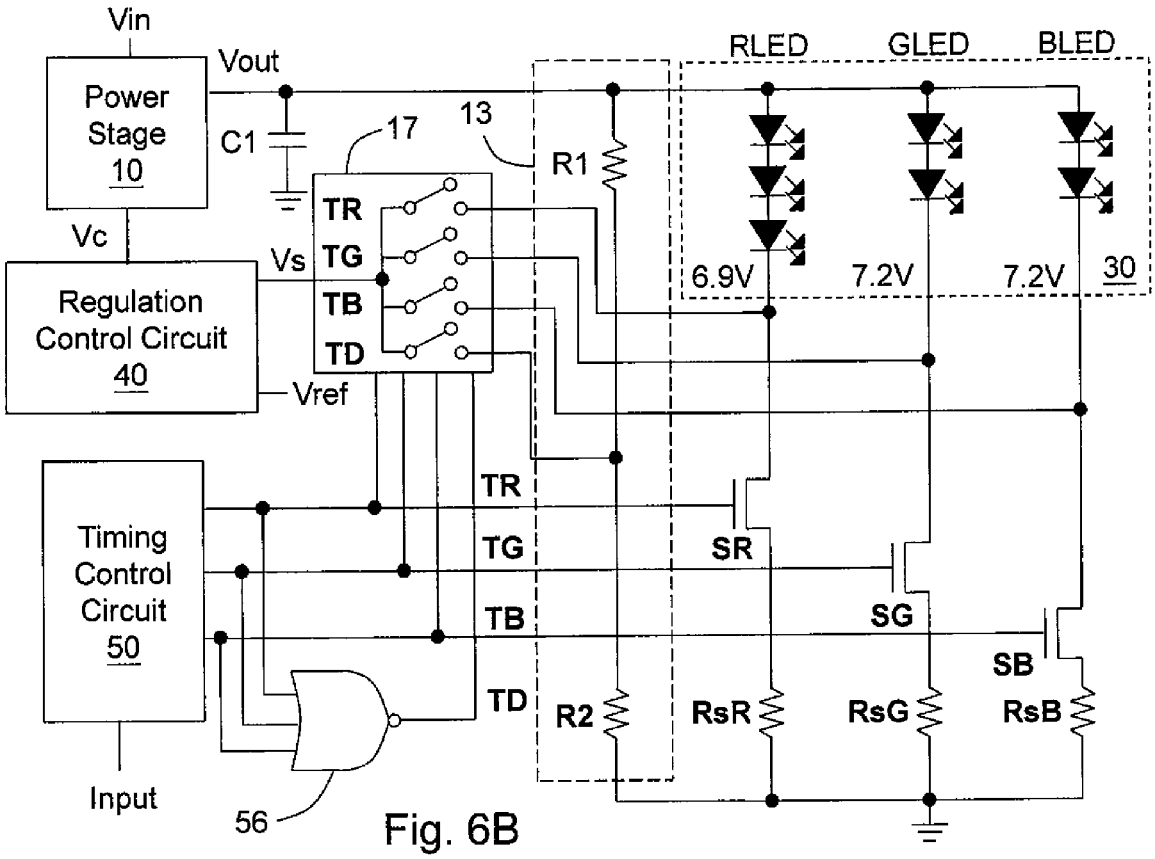

FIGS. 6A and 6B respectively show a fourth and a fifth embodiments of the present invention. Both embodiments are different from the first embodiment in that, the multi-color light emitting device circuit includes multiple sensing resistors RsR, RsG, and RsB, and the second selection circuit 17. The sensing resistors RsR, RsG, and RsB are coupled to corresponding color switches SR, SG, and SB respectively, and the resistance of the sensing resistors RsR, RsG, and RsB may be set to the same or different values, for example they may be set according to current that is designed to flow through the different color light emitting device strings. The second selection circuit 17 selects the sense signal Vs according to whether the timing control circuit 50 selects to conduct the color switch SR, SG, or SB, or the dark switch SD. That is, when the timing control circuit 50 generates the color timing control signal TR to conduct the color switch SR, the second selection circuit 17 selects the voltage across the sensing resistors RsR as the sense signal Vs; when the timing control circuit 50 generates the color timing control signal TG to conduct the color switch SG, the second selection circuit 17 selects the voltage across the sensing resistors RsG as the sense signal Vs; when the timing control circuit 50 generates the color timing control signal TB to conduct the color switch SB, the second selection circuit 17 selects the voltage across the sensing resistors RsB as the sense signal Vs; and when the timing control circuit 50 generates the dark timing control signal TD, the second selection circuit 17 selects the voltage across the second resistors R2 as the sense signal Vs. In both embodiments, the more options of the sense signal Vs increases the accuracy of the output voltage Vout, and increases the flexibility in circuit design. Furthermore, the settings of the sensing resistors RsR, RsG, and RsB may be used to control the brightness of the color light emitting device strings such that they have the same brightness under the same ON time without requiring controlling the ON time ratio. Certainly, the user still may control the brightness of the color light emitting device strings by the ratio of the ON time.

The embodiment shown in FIG. 6B is similar to that shown in FIG. 6A except that the sense signal Vs of each light emitting device string is obtained from a node above the color switch SR, SG, or SB (a current inflow end of the switch) instead of a node below the color switch SR, SG, or SB (a current outflow end of the switch).

Another notable feature in both embodiments shown in FIGS. 6A and 6B is that they omit the dark switch SD, and therefore a path from the output voltage Vout to ground via the dark feedback circuit 13 (including the first resistor R1 and the second resistor R2) will be kept conductive, while this does not impact the operation of the whole circuitry. Basically, the circuitry controls the operation of the power stage 10 to generate the output voltage Vout according to the sense signal Vs which is selected by the second selection circuit 17; only a small and ignorable leakage current flows through the path of the first resistor R1 and the second resistor R2 when the red LED string, the green LED string, or the blue LED string is conductive.

Figure 6C:
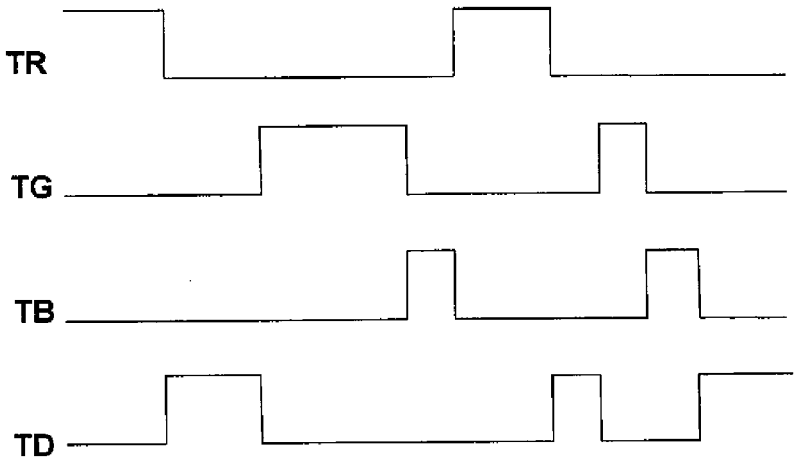
FIG. 6C shows the waveforms of timing control signals.

FIG. 6C is an example showing that the ratio of the ON time of the color light emitting device strings does not have to be 2:3:3 as aforementioned. The above description explains that although the numbers of the light emitting devices in different color light emitting device strings are different, the brightness of different colors can be kept the same, by controlling the ON time, providing reference signals of different levels, or providing sense resistors with different resistances.

Figure 7:
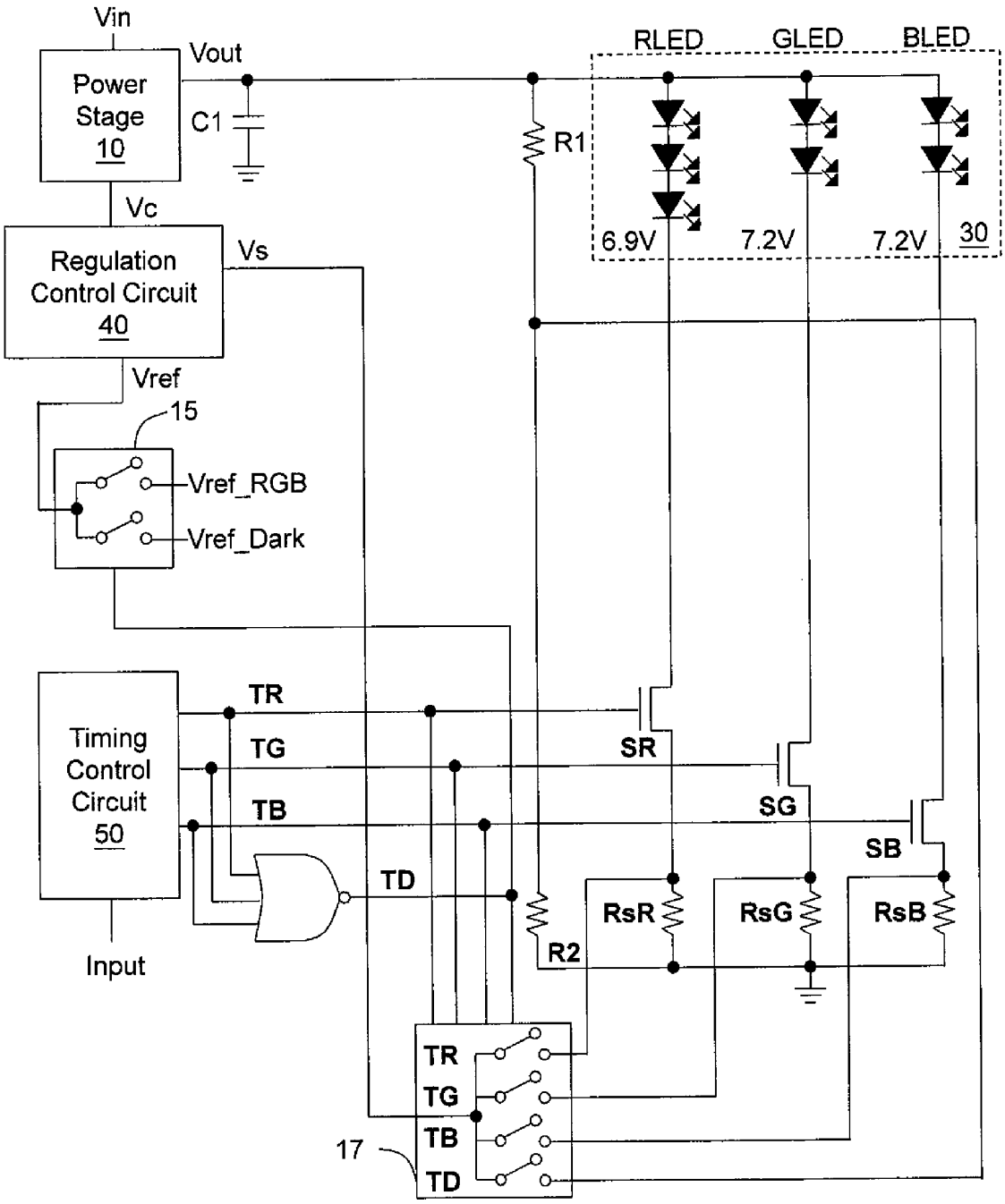
FIG. 7 shows a sixth embodiment of the present invention.

FIG. 7 shows a sixth embodiment of the present invention. In this embodiment, the sense signal Vs and the reference signal Vref are both selectable, such that the output voltage Vout is more precisely controlled, the flexibility in circuit design is increased, and/or the brightness of the color light emitting device strings is controlled more easily.

Figure 8:
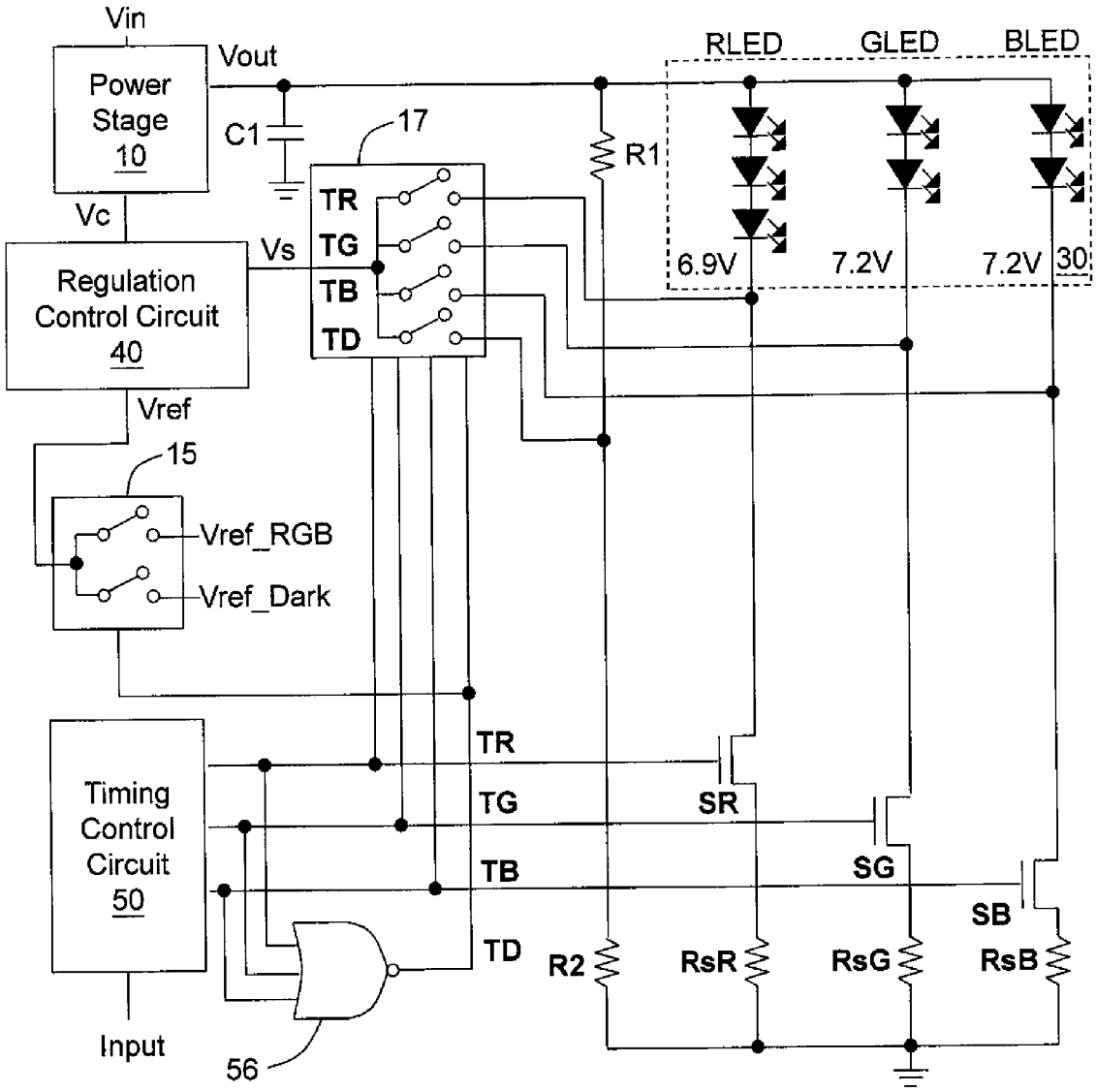
FIG. 8 shows a seventh embodiment of the present invention.

FIG. 8 shows a seventh embodiment of the present invention. This embodiment is similar to the embodiment shown in FIG. 7, except that the sense signal Vs of each light emitting device string is obtained from a node above the color switch SR, SG, or SB (a current inflow end of the switch) instead of a node below the color switch SR, SG, or SB (a current outflow end of the switch).

Figure 9:
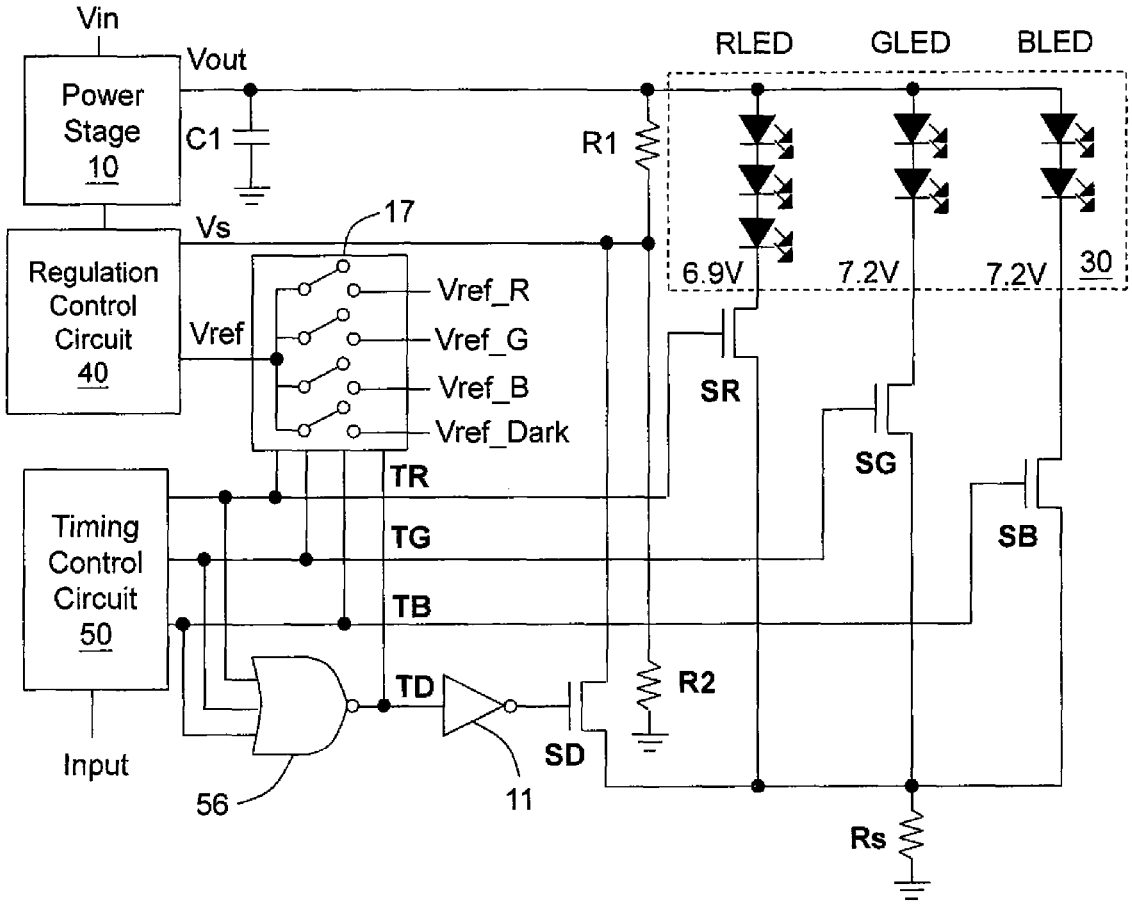
FIG. 9 shows an eighth embodiment of the present invention.

FIG. 9 shows an eighth embodiment of the present invention. This embodiment is similar to the third embodiment shown in FIG. 5A, but different in that the dark switch SD of this embodiment is coupled between the regulation control circuit 40 and the sensing resistor Rs, and is controlled by a control signal converted from the dark timing control signal TD by a NOT logic gate 11, wherein the dark timing control signal TD is generated by the logic gate 56 according to the color timing control signals TR, TG, and TB, which are generated by the timing control circuit 50 according to the input signal Input. More specifically, when one of the color timing signals TR, TG, and TB turns ON the corresponding color switch SR, SG, or SB, the dark switch SD is also turned ON. Therefore, the sense signal Vs is determined by the sensing resistor Rs and the second resistor R2 connected in parallel. Because the resistance of the sensing resistor Rs is much smaller than the resistances of the first resistor R1 and the second resistor R2, the sense signal Vs is determined by the sensing resistor Rs and is about equal to the voltage drop across the sensing resistor Rs. The sense signal Vs is fed back to control the power stage 10, so that the power stage 10 generates the output voltage Vout according to the sense signal Vs. On the other hand, when the color timing signals TR, TG, and TB turns OFF all the color switches SR, SG, and SB, the dark switch SD is also turned OFF. In this case, the sense signal Vs is the voltage drop across the second resistor R2, and the power stage 10 generates the output voltage Vout at the dark level accordingly.

Figure 10:
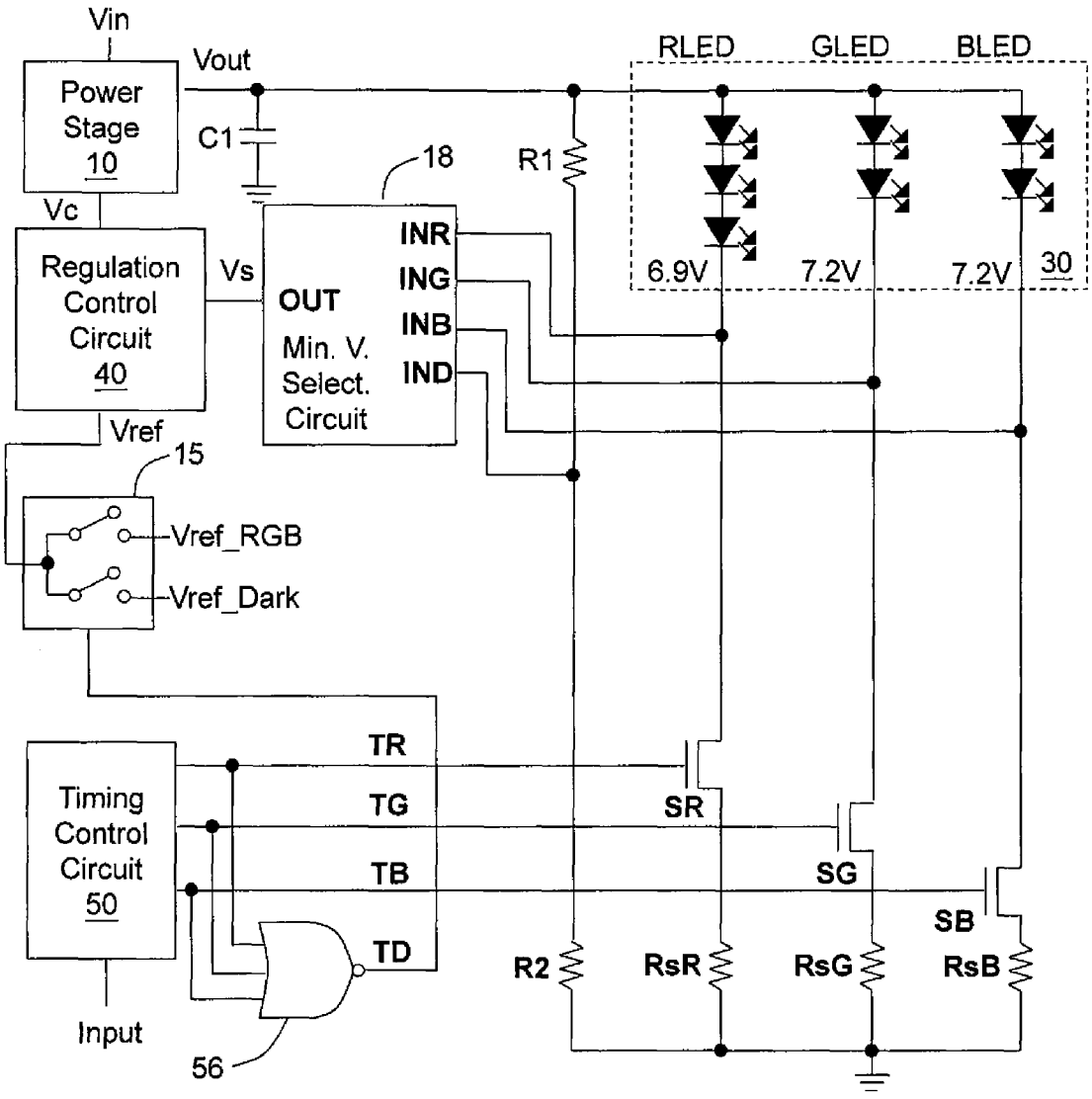
FIG. 10 shows a ninth embodiment of the present invention.

FIG. 10 shows a ninth embodiment of the present invention. This embodiment is similar to the embodiment shown in FIG. 8, but is different in that the second selection circuit 17 shown in FIG. 8 is replaced by a minimum voltage selection circuit 18, which is coupled to the second ends of the light emitting device strings and the second resistor R2, and receives voltages of the second ends of the light emitting device strings and the voltage drop across the second resistor R2 via connection nodes INR, ING, INB, and IND respectively. The minimum voltage selection circuit 18 selects a lowest voltage among the received voltages, and outputs the lowest voltage via an output node OUT, as the sense signal Vs. More specifically, when one of the color timing control signals TR, TG, and TB turns ON the corresponding color switch SR, SG, or SB, the voltage at the second end of the corresponding light emitting device string will be the lowest voltage which is taken as the sense signal Vs, and it is fed back to control the power stage 10 for generating the output voltage Vout. The reason why the conductive light emitting device string has the lowest voltage is that: no currents flow through the light emitting device strings which are not conductive, and therefore the voltage drops across the light emitting devices are relatively lower; as a result, the voltages at the second ends of the light emitting device strings which are not conductive will be close to the output voltage Vout, higher than the voltage of the conductive light emitting device string. By properly designing the resistances of the first resistor R1, the second resistor R2, and the sensing resistors RsR, RsG, and RsB, and the voltage at the second end of the conductive light emitting device string will be the lowest, and selected by the minimum voltage selection circuit 18 as the minimum voltage.

Figure 11:
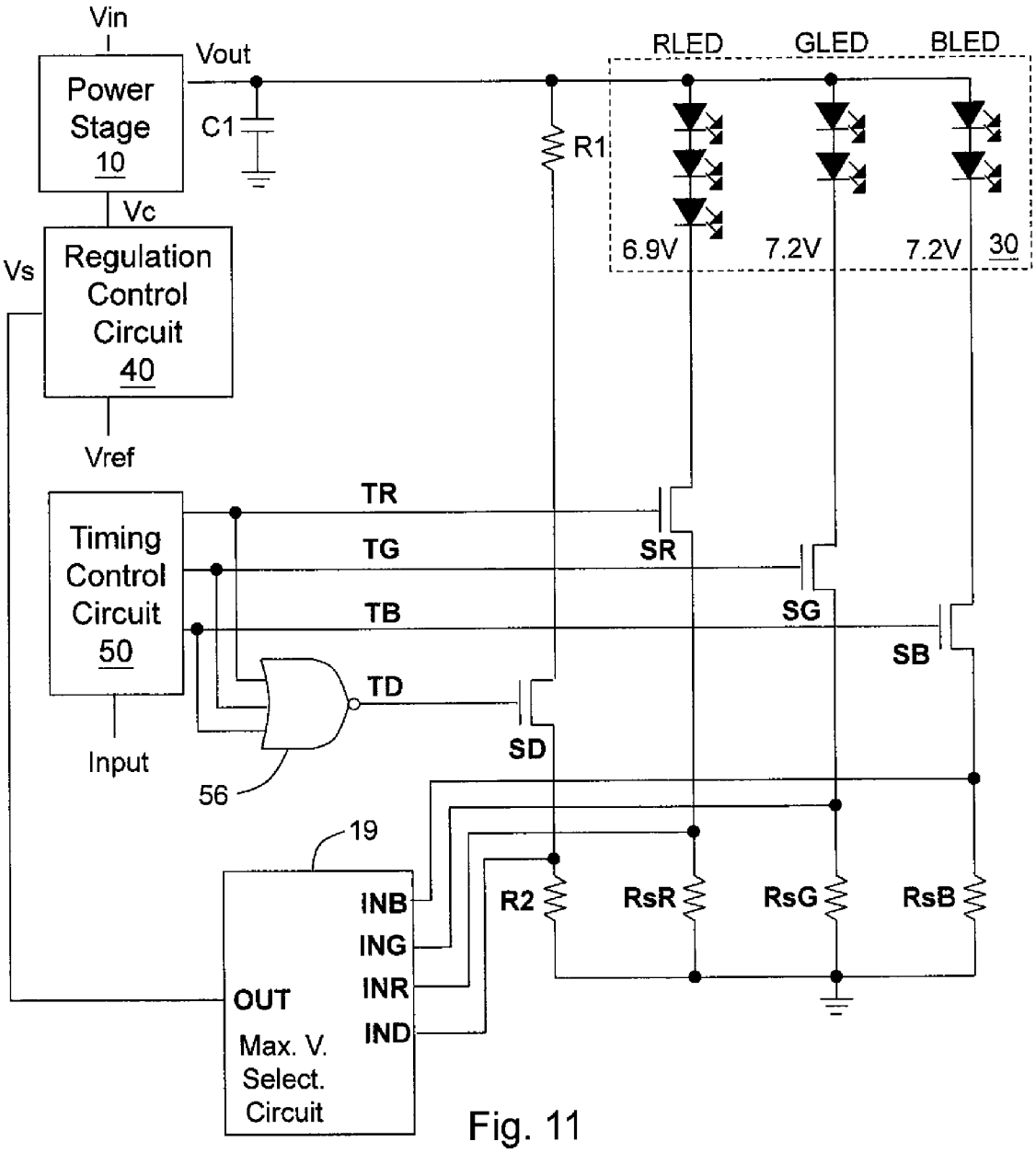
FIG. 11 shows a tenth embodiment of the present invention.

FIG. 11 shows a tenth embodiment of the present invention. This embodiment is similar to the embodiment shown in FIG. 7 but without the first selection circuit 15, and another difference from the embodiment shown in FIG. 7 is that, the second selection circuit 17 shown in FIG. 7 is replaced by a maximum voltage selection circuit 19, which is coupled to the sensing resistors RsR, RsG, and RsB, and the second resistor R2. The maximum voltage selection circuit 19 receives the voltage drops across the sensing resistors RsR, RsG, and RsB, and the second resistor R2, and selects a highest voltage among the received voltages to be outputted as the sense signal Vs. More specifically, when one of the color timing control signals TR, TG, and TB turns ON the corresponding color switch SR, SG, or SB, the voltage drops across the sensing resistors corresponding to those light emitting device strings which are not conductive are zero, so the voltage drop across the sensing resistor of the conductive light emitting device string will be the highest and selected by the maximum voltage selection circuit 19 as the sense signal Vs, which is fed back to control the power stage 10 for generating the output voltage Vout.

Figure 12:
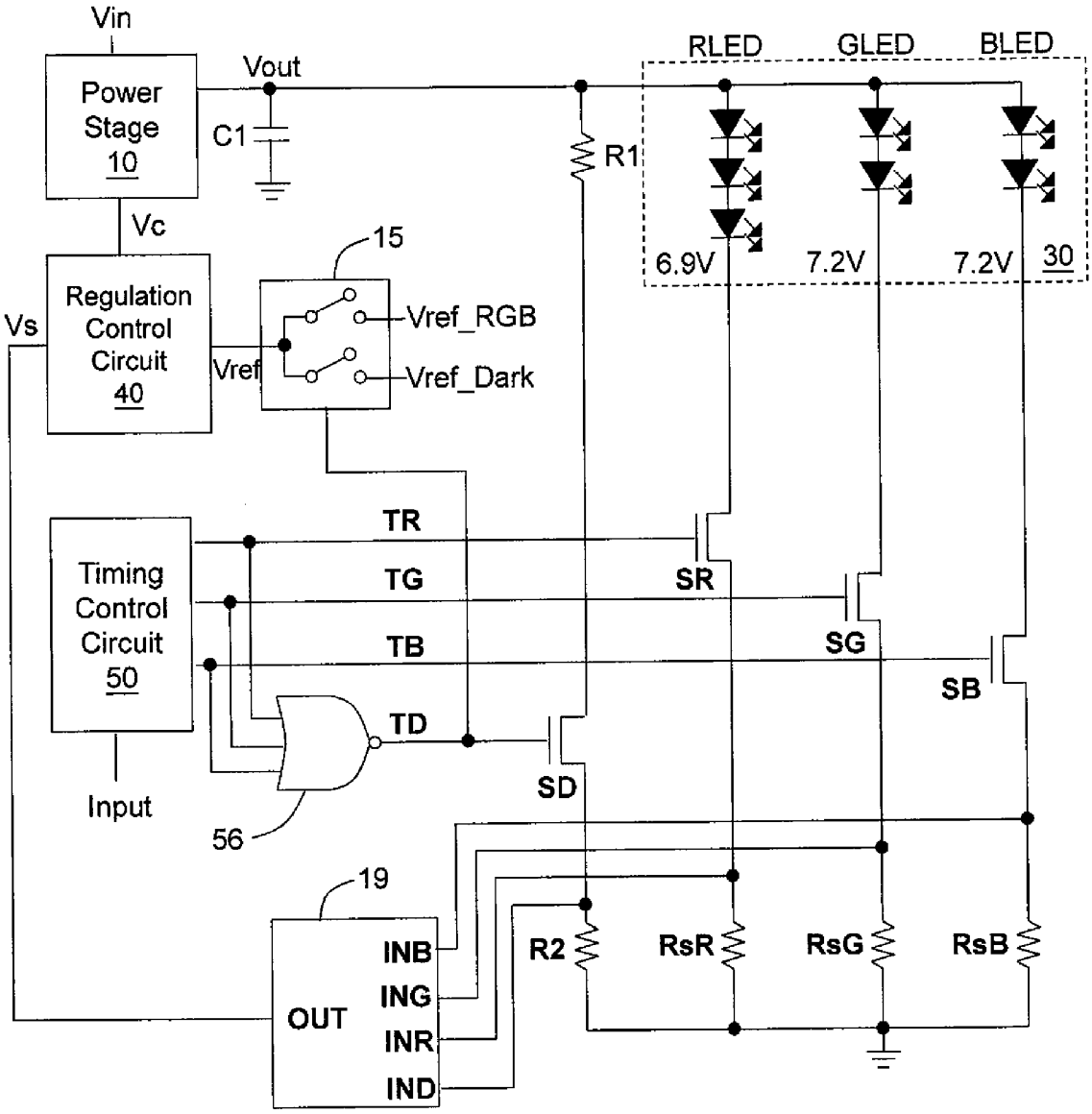
FIG. 12 shows an eleventh embodiment of the present invention.
Figure 13A:
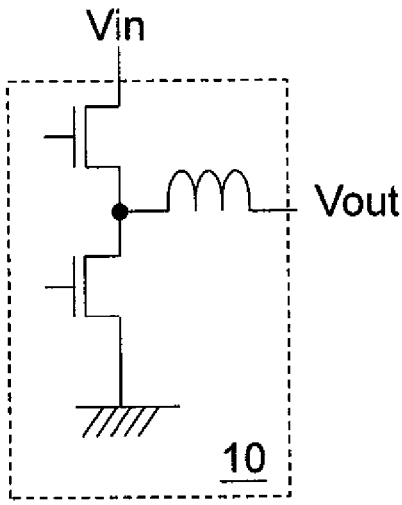
FIGS. 13A-13H show several embodiments of a power stage 10.
Figure 13B:
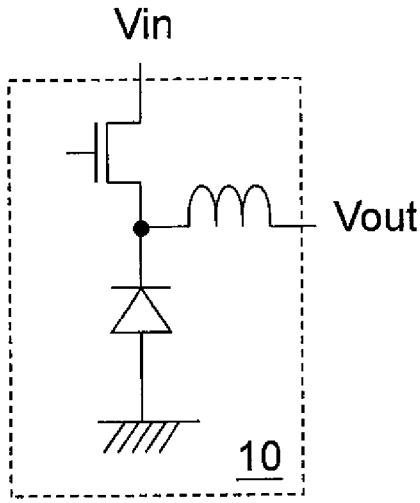
Figure 13C:
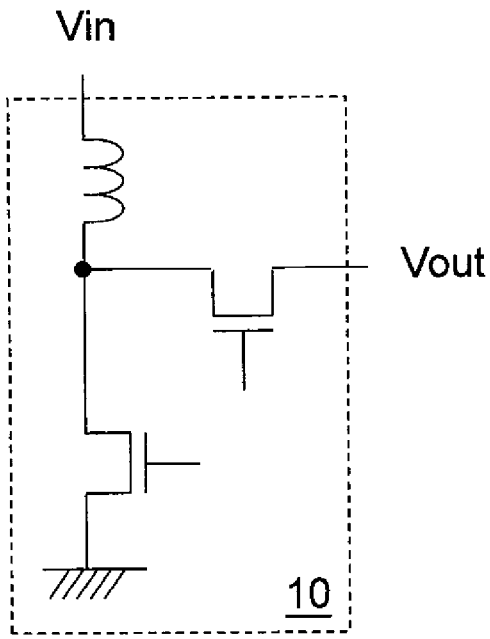
Figure 13D:
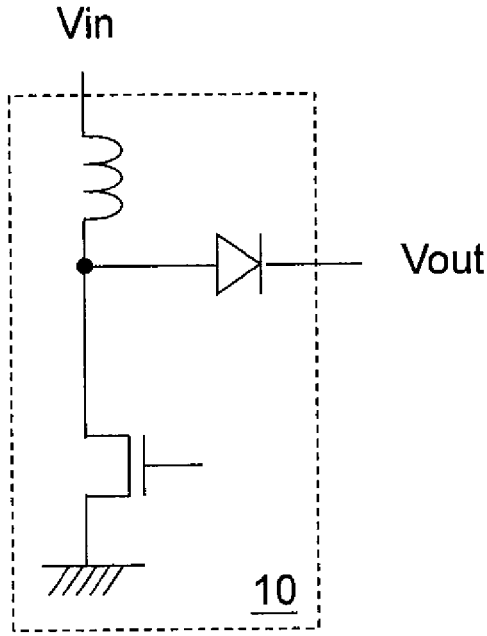
Figure 13E:
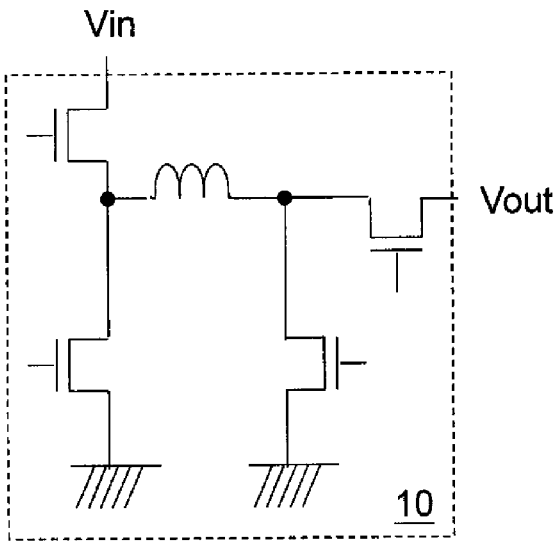
Figure 13F:
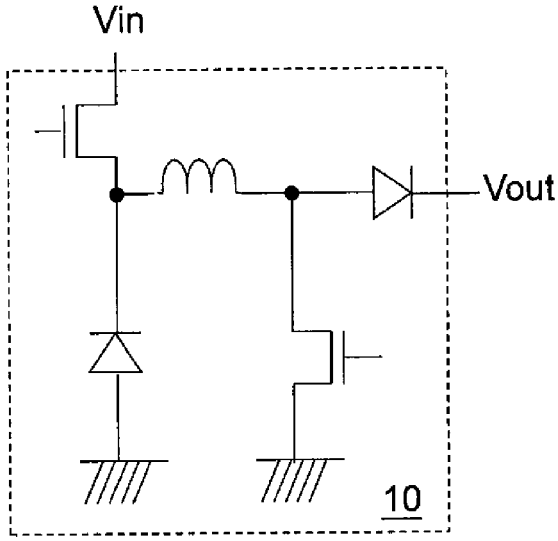
Figure 13G:
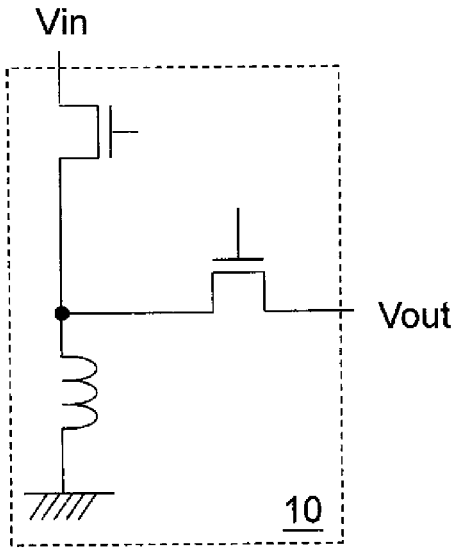
Figure 13H:
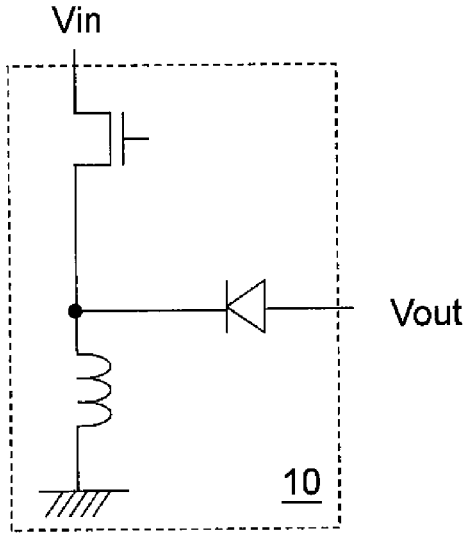

FIG. 12 shows an eleventh embodiment of the present invention. This embodiment is similar to the one shown in FIG. 11, and is different in that this embodiment further includes the first selection circuit 15, which selects the color reference signal Vref_RGB, or the dark reference signal Vref_Dark as the reference signal Vref. And the dark switch SD is provided in the embodiments shown in FIGS. 11 and 12.

In the aforementioned embodiments, if the dark level is not required, the circuitry needs not include the dark feedback circuit 13, the logic gate 56, and the dark switch SD, and the selection circuits 15, 17, 18, and 19 do not need to provide the option corresponding to the dark feedback circuit 13.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, the numbers of the light emitting devices coupled in series in the light emitting device strings are not limited to the numbers shown in the figures, i.e., 3 red LEDs in series, 2 green LEDs in series, and 2 blue LEDs in series; the numbers may be changed to any other numbers, such as 11 red LEDs in series (11*2.3V=25.3V), 7 green LEDs in series (7*3.6V=25.2V), and 7 blue LEDs in series (7*3.6V=25.2V), etc. For another example, a device which does not substantially influence the primary function of a signal can be inserted between any two devices in the shown embodiments, such as a switch. For yet another example, in some applications, the output voltage Vout is negative, and the light emitting devices are reversely coupled to the output voltage Vout; the present invention is still applicable with corresponding amendments of the circuit. For yet another example, the second resistor R2 may be omitted in some embodiments (such as the ones shown in FIGS. 3A, 4A, and 5A). For yet another example, in the embodiments shown in FIGS. 7, 8, 10 and 12, the first selection circuit 15 may be replaced by a circuit with four inputs for receiving the reference signals Vref_R, Vref_G, Vref_B, and the dark reference signal Vref_Dark as options of the reference signal Vref, etc. In view of the foregoing, the spirit of the present invention should cover all such and other modifications and variations, which should be interpreted to fall within the scope of the following claims and their equivalents.

What is claimed is:

1. A multi-color light emitting device circuit, comprising:

a plurality of light emitting device strings of different colors, each light emitting device string including a plurality of light emitting devices of a same color coupled in series, wherein each light emitting device string has one end coupled to a common node for receiving an output voltage, and each light emitting device string generates a corresponding sense signal;

a timing control circuit, which determines to turn ON a selected one or none of the light emitting device strings; and a power regulator circuit, when the selected one of the light emitting device strings is ON, the power regulator circuit comparing the sense signal corresponding to the selected light emitting device string with a reference signal, and converting an input voltage to the output voltage according to the comparison result;

wherein the number of the light emitting devices of each light emitting device string is determined by an operational voltage of a light emitting device of a color substantially the same as the color of the light emitting devices in that light emitting device string, and wherein at least two of the light emitting device strings have different numbers of the light emitting devices, such that voltage drops of the two light emitting device strings are closer to each other than in a case wherein the two light emitting device strings have the same number of the light emitting devices.

2. The multi-color light emitting device circuit of claim 1, further comprising a dark feedback circuit for generating a dark feedback signal, when none of the light emitting device strings is ON, the power regulator circuit comparing the dark feedback signal with the reference signal and converting the input voltage to the output voltage according to the comparison result.

3. The multi-color light emitting device circuit of claim 1, further comprising a dark feedback circuit for generating a dark feedback signal, when none of the light emitting device strings is ON, the power regulator circuit comparing the dark feedback signal with a dark reference signal and converting the input voltage to the output voltage according to the comparison result.

4. The multi-color light emitting device circuit of claim 2, wherein the dark feedback circuit is kept conductive.

5. The multi-color light emitting device circuit of claim 3, wherein the dark feedback circuit is kept conductive.

6. The multi-color light emitting device circuit of claim 1, further comprising one common sensing resistor, which is coupled to all of the light emitting device strings, for providing the sense signal.

7. The multi-color light emitting device circuit of claim 1, further comprising a plurality of sensing resistors, which are coupled to the light emitting device strings respectively, for providing the sense signal.

8. The multi-color light emitting device circuit of claim 1, further comprising a selection circuit, which receives a plurality of color reference signals, and selects one of the color reference signals as the reference signal, wherein the selected color reference signal corresponds to the light emitting device string determined by the timing control circuit to turn ON.

9. The multi-color light emitting device circuit of claim 6, further comprising a selection circuit, which receives a plurality of color reference signals, and selects one of the color reference signals as the reference signal, wherein the selected color reference signal corresponds to the light emitting device string determined by the timing control circuit to turn ON.

10. The multi-color light emitting device circuit of claim 7, further comprising a selection circuit, which receives a plurality of color reference signals, and selects one of the color reference signals as the reference signal, wherein the selected color reference signal corresponds to the light emitting device string determined by the timing control circuit to turn ON.

11. The multi-color light emitting device circuit of claim 7, further comprising a selection circuit, which is coupled to the light emitting device strings at corresponding nodes respectively, to obtain the sense signals corresponding to the light emitting device strings, and select one of the sense signals to be inputted to the power regulator circuit.

12. The multi-color light emitting device circuit of claim 7, further comprising:

a dark feedback circuit for generating a dark feedback signal, and a selection circuit, which is coupled to the light emitting device strings and the dark feedback circuit at corresponding nodes respectively, to obtain the sense signals corresponding to the light emitting device strings and the dark feedback signal, and select one of the sense signals and the dark feedback signal, which is to be inputted to the power regulator circuit.

13. The multi-color light emitting device circuit of claim 11, wherein the selection circuit includes one of the following circuits: a maximum voltage selection circuit, a minimum voltage selection circuit, and a selection circuit controlled by the timing control circuit.

14. The multi-color light emitting device circuit of claim 12, wherein the selection circuit includes one of the following circuits: a maximum voltage selection circuit, a minimum voltage selection circuit, and a selection circuit controlled by the timing control circuit.

* * * * *